US008950845B2

(12) United States Patent
Nagoshi et al.

(10) Patent No.: US 8,950,845 B2
(45) Date of Patent: Feb. 10, 2015

(54) PRINTING APPARATUS

(71) Applicant: Canon Kabushiki Kaisha, Tokyo (JP)

(72) Inventors: Shigeyasu Nagoshi, Yokohama (JP); Makoto Torigoe, Tokyo (JP); Yoshiaki Murayama, Tokyo (JP); Satoshi Azuma, Kawasaki (JP); Kei Kosaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/873,409

(22) Filed: Apr. 30, 2013

(65) Prior Publication Data

US 2013/0235115 A1 Sep. 12, 2013

Related U.S. Application Data

(62) Division of application No. 12/965,664, filed on Dec. 10, 2010.

(30) Foreign Application Priority Data

Sep. 1, 2010 (JP) ..... 2010-195710

(51) Int. Cl.
*B41J 29/393* (2006.01)

(52) U.S. Cl.
USPC ..... 347/19; 347/5; 347/14

(58) Field of Classification Search
USPC ..... 347/4, 5, 9, 14, 16, 19, 101
See application file for complete search history.

(56) References Cited

U.S. PATENT DOCUMENTS

| | | | | |
|---|---|---|---|---|
| 5,764,263 | A * | 6/1998 | Lin | 347/101 |
| 6,805,421 | B2 * | 10/2004 | Eck et al. | 347/12 |
| 7,311,368 | B2 * | 12/2007 | Kawakami | 347/5 |
| 7,726,760 | B2 * | 6/2010 | Ikefuji et al. | 347/13 |
| 2004/0090475 | A1 * | 5/2004 | Ioka et al. | 347/5 |

FOREIGN PATENT DOCUMENTS

| | | | |
|---|---|---|---|
| JP | 2008-030899 | A | 2/2008 |
| JP | 2010-069872 | A | 4/2010 |

* cited by examiner

*Primary Examiner* — Lam S Nguyen
(74) *Attorney, Agent, or Firm* — Canon U.S.A., Inc. IP Division

(57) ABSTRACT

A printing apparatus conducts inspection associated with printing by changing a relative positional relationship between a line print head and a sheet feeding position for a sheet in a direction perpendicular to a direction in which the sheet is fed, forming an image on the sheet using the line print head a plurality of times, and reading the formed images using a reading unit.

4 Claims, 8 Drawing Sheets

PRINTING APPARATUS

CROSS-REFERENCE TO RELATED APPLICATIONS

This application is a divisional application of U.S. patent application Ser. No. 12/965,664 filed Dec. 10, 2010, which claims the benefit of Japanese Patent Application No. 2010-195710 filed Sep. 1, 2010. Each of U.S. patent application Ser. No. 12/965,664 and Japanese Patent Application No. 2010-195710 is hereby incorporated by reference herein in its entirety.

BACKGROUND OF THE INVENTION

1. Field of the Invention

The present invention relates to a printing apparatus capable of conducting inspection associated with printing on the basis of an image read using an image reading unit.

2. Description of the Related Art

A method for inspecting the state of a print head by reading an image formed by the print head using an image reading unit and analyzing the image has been developed. Japanese Patent Laid-Open No. 6-253144 describes a method for correcting nonuniformity of reading an image caused by nonuniformity of the readout sensitivity of the image reading unit and the illuminance distribution that differs from point to point, that is, shading distortion.

SUMMARY OF THE INVENTION

The present inventor realized that the following problem arose in a printing apparatus capable of processing sheets having a variety of sizes when an image formed on a sheet was read for inspection. FIG. 1 is a schematic illustration of a positional relationship between a print head PH and a line sensor LS of an image reading unit (an image scanner). In FIG. 1, a sheet S is conveyed from the bottom to the top. The line print head PH is disposed on the upstream side, and the line sensor LS of the image reading unit is disposed on the downstream side. Part of a conveyer unit TR for conveying a sheet (e.g., a conveying roller and a sheet supporting surface of a platen) is disposed on the opposite side of the sheet S from the line sensor LS. A surface of the sheet is uniformly illuminated in a slit shape with light emitted from a light source included in the image reading unit. The illuminated area is read by the line sensor LS.

At that time, the signal level output from the line sensor LS when light is received from an area A located in the width direction of the sheet S differs from the signal level output from the line sensor LS when light is received from an area B. A graph SG illustrated in the upper section of FIG. 1 indicates an example of an output signal output from the line sensor LS. As can be seen from the graph SG, the output signal level for the area B located at either end of the sheet S is lower than that for the area A including the middle area of the sheet S in the width direction. Even within the area B, the signal level abruptly decreases towards the end of the sheet S.

This is because the reflectivity of light from the surface of the sheet S differs from that from the surface of the conveyer unit TR. In general, the surface of the sheet S is white, and the reflectivity of light is high. In contrast, in general, the reflectivity of light from either one of the conveying roller (a black rubber material) and the platen of the conveyer unit TR is lower than that from the sheet S. In the area A, in addition to the light beam reflected at a position in a sheet to be detected, light beams reflected at neighboring points of the sheet on either side of the point to be detected are made incident on a photodetector of the line sensor. However, in the area B, in addition to the light beam reflected at a position in a sheet to be detected, a light beam reflected at a neighboring point of the surface and a light beam reflected by the surface of the conveyer unit TR that is not covered by the sheet and is exposed are made incident on a photodetector of the line sensor. Since the reflectivity of light from the surface of the conveyer unit TR is lower than that from a sheet, the amount of light made incident on the photodetector in the area B is smaller than that in the area A. Even in the area B, since the percentage of the light reflected by the surface of the conveyer unit TR increases towards the end of the sheet, the amount of light made incident on the photodetector further decreases. In addition, if the size of the employed sheet in the width direction is changed, the exposed area of the conveyer unit TR varies. Thus, the amount of light made incident on the light receiving surface in the area B can vary. That is, even when the illumination distribution of light in the area A is the same as that in the area B, the output of the photodetector in the area B is smaller than that in the area A. In addition, in the area B, the output of the photodetector is nonuniform. As a result, in the area B, it is difficult to correctly inspect the element of the print head PH. In the area B, such a problem becomes more prominent towards the end of a sheet.

Accordingly, the present invention provides a printing apparatus capable of conducting inspection of a print head on the basis of an image read using an image reading unit and capable of conducting inspection associated with printing more accurately than an existing printing apparatus.

According to an embodiment of the present invention, an apparatus includes a print head of a line-type having a plurality of recording elements arranged in a direction including a second direction perpendicular to a first direction in which a sheet is conveyed, a reading unit including a sensor, where the sensor includes a plurality of photodetectors arranged in a direction including the second direction and the reading unit reads an image formed on the sheet, and a control unit configured to control in order to conduct inspection associated with printing such that a relative positional relationship between the print head and a sheet feeding position for the sheet in the second direction is changed and an image is formed on the sheet using the print head a plurality of times, and the formed images are read using the reading unit.

According to the present invention, a printing apparatus can conduct inspection associated with printing on the basis of an image using an image reading unit more accurately than an existing printing apparatus.

Further features of the present invention will become apparent from the following description of exemplary embodiments with reference to the attached drawings.

DESCRIPTION OF THE EMBODIMENTS

An inkjet printing apparatus according to embodiments of the present invention is described below. The printing apparatus according to embodiments of the present invention employs a long continuous sheet (a long continuous sheet that is longer than repeated units of printing in the conveying direction (the unit is referred to as a "page" or a "unit image")). The printing apparatus is a high-speed line printer that is operable in either one of a simplex print mode and a duplex print mode. The printing apparatus is suitable for a high-volume printing market, such as print labs. As used herein, even when a plurality of small images, characters, and white spaces are present in an area of a unit of printing (a page), the small images, characters, and white spaces are collectively referred to as a "unit image". That is, the term "unit image" refers to a unit of printing (a page) when a plurality of pages are sequentially printed on a continuous sheet. Note that a unit image is also simply referred to as an "image". The length of a unit image varies in accordance with the image size to be printed. For example, the length of an L size photo in the conveying direction is 135 mm, and the length of an A4 size photo in the sheet conveying direction is 297 mm. The present invention is widely applicable to printing apparatuses, such as a printer, a multi function peripheral, a copier, a facsimile, or equipment used for manufacturing a variety of devices. The printing method is not limited to an inkjet method. For example, any print method, such as an electrophotographic method, thermal transfer method, a dot impact method, or a liquid development method, can be employed.

First Embodiment

Figure 2:
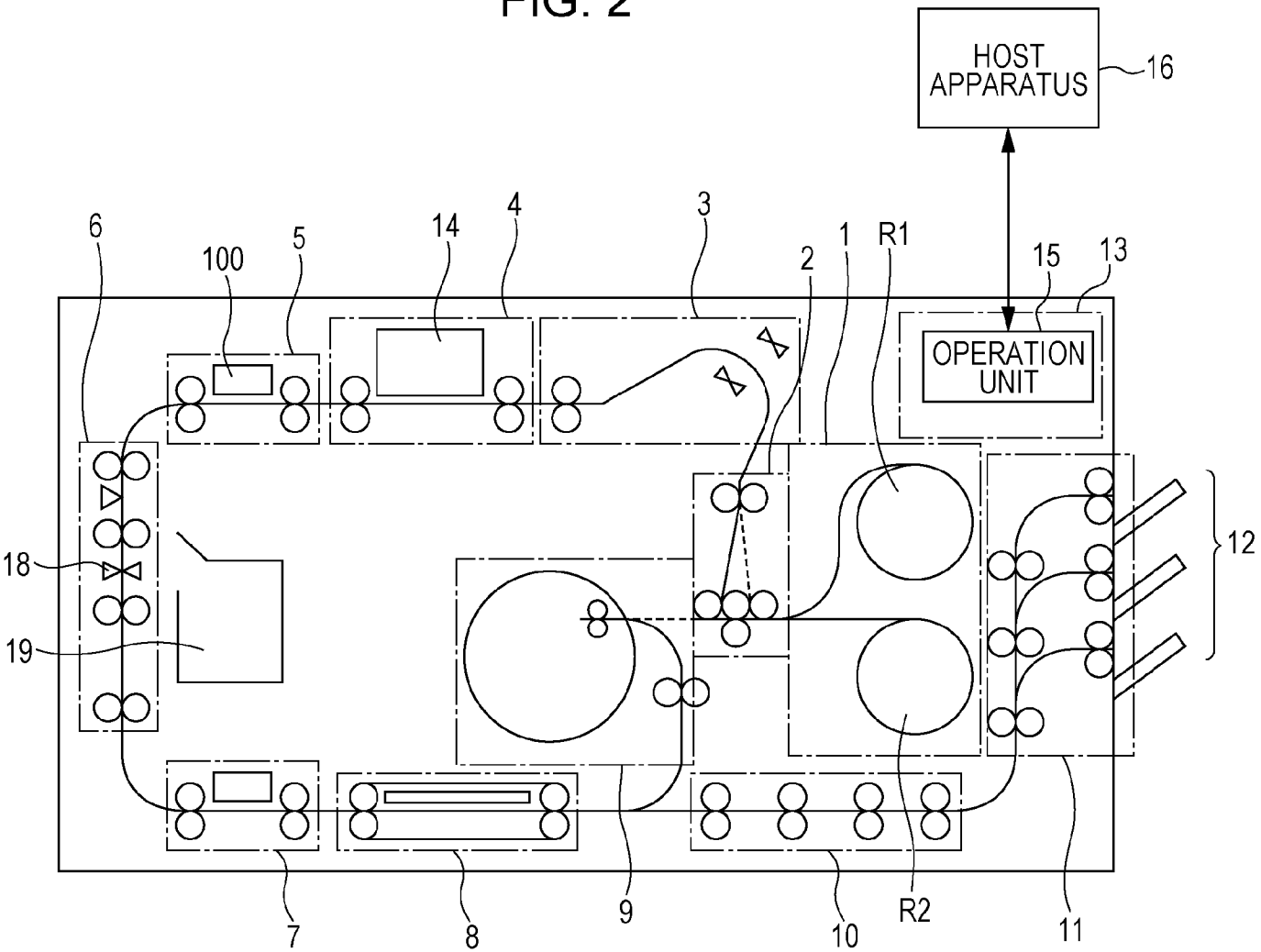
FIG. 2 is a schematic illustration of the configuration of a printing apparatus.

FIG. 2 is a schematic cross-sectional view of the internal configuration of the printing apparatus. The printing apparatus according to the present embodiment can perform duplex printing on a first surface of a rolled sheet and a second surface of the sheet which is a back surface of the first sheet. The printing apparatus includes a sheet feeding unit 1, a decurl unit 2, a skew correction unit 3, a printing unit 4, an inspection unit 5, a cutter unit 6, an information recording unit 7, a drying unit 8, an reverse unit 9, an ejection conveying unit 10, a sorter unit 11, an ejection unit 12, and a control unit 13. The ejection unit 12 includes the sorter unit 11. The ejection unit 12 performs a process for ejecting a sheet. The sheet is conveyed by a conveying mechanism including rollers and a belt along a sheet conveying path shown as a solid line in FIG. 2 and is processed by the units. At any point in the sheet conveying path, the side adjacent to the sheet feeding unit 1 is referred to as "upstream", and the side opposite to the side adjacent to the sheet feeding unit 1 is referred to as "downstream".

The sheet feeding unit 1 holds a rolled continuous sheet and feeds the continuous sheet. The sheet feeding unit 1 can contain two rolls R1 and R2. The sheet feeding unit 1 selects one of the rolls R1 and R2 and draws a sheet from the selected roll and feeds the sheet. Note that the number of rolls contained in the sheet feeding unit 1 is not limited to two. For example, the number of contained rolls may be one or three or more. Alternatively, a continuous sheet that is not rolled can be used. For example, a continuous sheet having perforations at predetermined intervals may be folded at the perforations and stacked in the sheet feeding unit 1.

The decurl unit 2 reduces the curl of the sheet fed from the sheet feeding unit 1. The decurl unit 2 allows the sheet to pass therethrough using two pinch rollers corresponding to one driving rollers in order to curve the sheet so that an inverse curl is supplied to the sheet. In this way, a decurling force is applied to the sheet and, therefore, the curl is reduced.

The skew correction unit 3 corrects the skew of the sheet that has passed through the decurl unit 2 (the inclination of the sheet with respect to the designed feed direction). By urging the end of the sheet on the reference side against a guide member, the skew can be corrected. In the skew correction unit 3, a loop of the conveyed sheet is formed.

The printing unit 4 performs a printing operation on the sheet and forms an image on the sheet using a print head assembly 14 disposed above the conveyed sheet. That is, the printing unit 4 serves as a sheet processing unit. The printing unit 4 includes a plurality of conveying rollers that convey the sheet. The print head assembly 14 includes a print head of a line-type having an inkjet nozzle row (recording elements) that covers the maximum width of the sheet to be used. In the print head assembly 14, a plurality of print heads are arranged in parallel along the conveying direction. In this example, the print head assembly 14 includes seven print heads corresponding to the following seven colors: cyan (C), magenta (M), yellow (Y), light cyan (LC), light magenta (LM), grey (G), and black (K). However, it should be noted that the number of colors and the number of print heads are not limited to seven. In order to eject ink from the inkjet nozzle, one of the following methods can be employed: a method using a heater element, a method using a piezoelectric element, a method using an electrostatic element, and a method using a microelectromechanical system (MEMS) element. The ink of each color is supplied from an ink tank to the print head assembly 14 via an ink tube. In addition, as described in more detail below, the printing unit 4 includes a moving mechanism that can displace the print head assembly 14 in the width direction of the sheet.

The inspection unit 5 optically scans, using an image reading unit 100, a measurement image formed on the sheet by the printing unit 4 and conducts inspection associated with printing, such as the state of a nozzle of the print head, the conveying state of a sheet, and the position of the printed image. The image reading unit 100 includes a charge-coupled device (CCD) image sensor or a complementary metal-oxide semiconductor (CMOS) image sensor. The inspection unit 5 is described in more detail below.

The cutter unit 6 includes a mechanical cutter 18 that cuts the printed sheet into predetermined lengths. The cutter unit 6 further includes a cut mark sensor that optically detects cut marks recorded on the sheet and a plurality of conveying rollers that convey the sheet to the next processing stage. A trash can 19 is disposed in the vicinity of the cutter unit 6. The trash can 19 contains small sheet tips generated by and output from the cutter unit 6 as trash. The cutter unit 6 includes a dispatching mechanism that determines whether the cut sheet is output to the trash can 19 or the original conveying path.

The information recording unit 7 records print information (unique information), such as the serial number of the printout and the date and time, in the non-print area of the cut sheet. The information is recorded by printing characters and code by using, for example, an inkjet method or a thermal transfer method.

The drying unit 8 heats the sheet printed by the printing unit 4 so as to dry the applied ink in a short time. In the drying unit 8, heated air is applied to the sheet that passes through the drying unit 8 in at least the upward direction. Note that instead of applying heated air, the drying unit 8 can dry the ink by irradiating the surface of the sheet with electromagnetic waves (e.g., ultraviolet rays or infrared rays).

The reverse unit 9 temporarily winds the printed continuous sheet and turns over the sheet when duplex printing is performed. In order to feed the sheet that has passed through the drying unit 8 to the printing unit 4 again, the reverse unit 9 is disposed in a path from the drying unit 8 to the printing unit 4 via the decurl unit 2 (a loop path, hereinafter referred to as a "second path"). The reverse unit 9 includes a winding rotary member (a drum) that rotates to reel in the sheet. The printed continuous sheet before being cut is temporarily wound around the winding rotary member. After the continuous sheet is wound, the winding rotary member rotates in the opposite direction and, therefore, the continuous sheet is fed in a direction opposite that when the continuous sheet is wound. The continuous sheet is fed to the decurl unit 2 and is delivered to the printing unit 4. Since the sheet is turned over, the printing unit 4 can perform a printing operation on the back surface of the sheet. If the sheet feeding unit 1 is referred to as a "first sheet feeding unit", the reverse unit 9 can be referred to as a "second sheet feeding unit." Such duplex printing is described in more detail below.

The ejection conveying unit 10 conveys the sheet cut by the cutter unit 6 and dried by the drying unit 8 and delivers the sheet to the sorter unit 11. The ejection conveying unit 10 is disposed in a path that is different from the second path having the reverse unit 9 therein (hereinafter, referred to as a "third path"). In order to selectively deliver the sheet that has been conveyed along the first path to the second path or the third path, a path switching mechanism including a movable flapper is disposed at a branch position in the path.

The ejection unit 12 including the sorter unit 11 is disposed at the end of the third path so as to be adjacent to the sheet feeding unit 1. The sorter unit 11 sorts the printed sheets into groups as needed. The sorted sheets are ejected onto a plurality of trays of the ejection unit 12. In this way, the third path is designed so as to allow a sheet to pass beneath the sheet feeding unit 1 and allow the sheet to be ejected to the opposite side of the sheet feeding unit 1 from the printing unit 4 and the drying unit 8.

As described above, the units from the sheet feeding unit 1 to the drying unit 8 are sequentially arranged along the first path. Downstream of the drying unit 8, the first path branches into the second path and the third path. The reverse unit 9 is disposed in the middle of the second path. Downstream of the reverse unit 9, the second path merges with the first path. The ejection unit 12 is disposed at the end of the third path.

The control unit 13 performs overall control of the printing apparatus. The control unit 13 includes a controller having a central processing unit (CPU), a storage unit, and a variety of control sub-units, an external interface, and an operation unit 15 used by the user when the user inputs data and receives output data. The operation performed by the printing apparatus is controlled using instructions sent from the controller or a host apparatus 16, such as a host computer, connected to the controller via the external interface.

Figure 3:
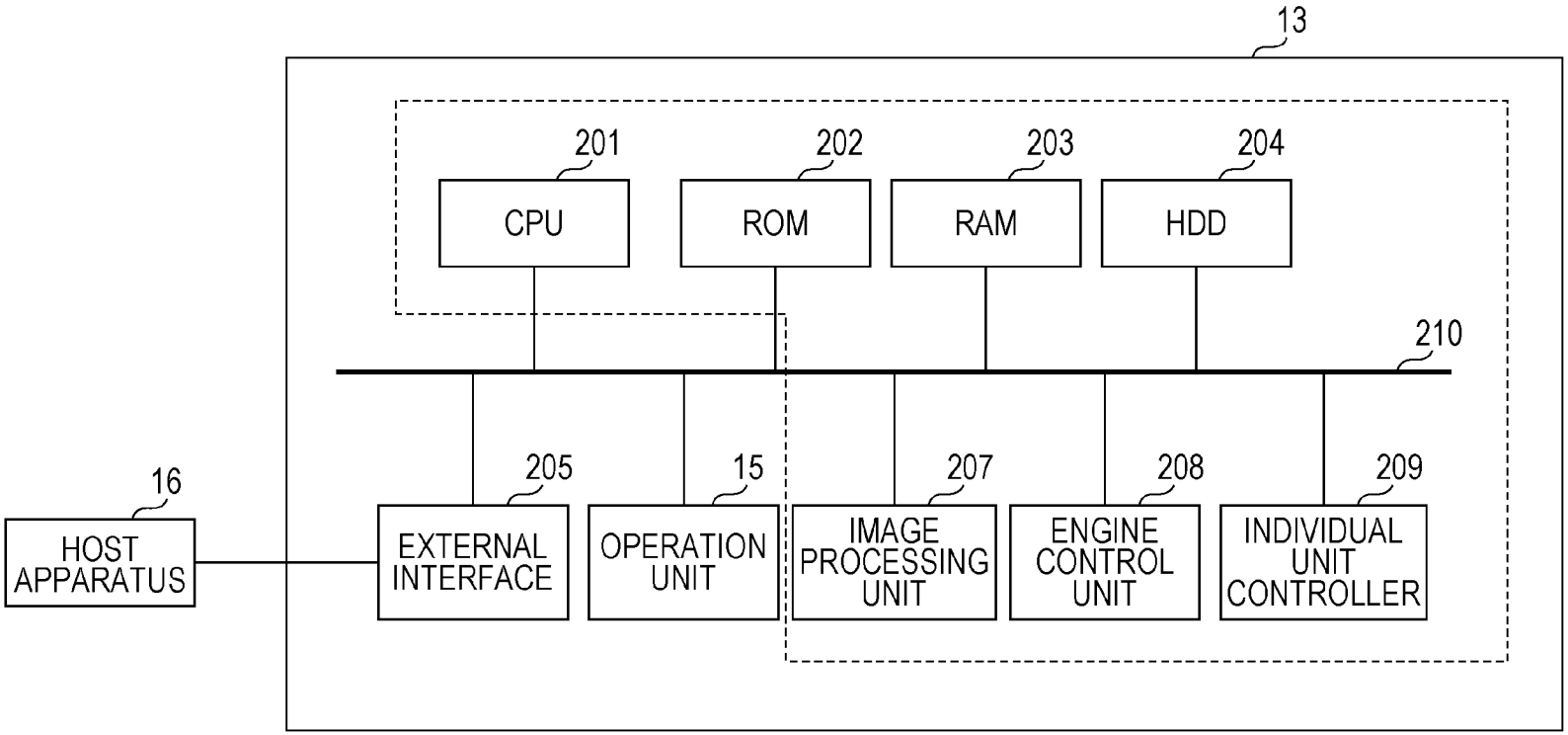
FIG. 3 is a block diagram of a control unit.

FIG. 3 is a block diagram schematically illustrating the control unit 13. The controller (a block enclosed by a dashed line) included in the control unit 13 includes a CPU 201, a read only memory (ROM) 202, a random access memory (RAM) 203, a hard disk drive (HDD) 204, an image processing unit 207, an engine control unit 208, an individual unit controller 209. The CPU 201 performs overall control of the printing apparatus. The ROM 202 stores programs executed by the CPU 201 and fixed data necessary for the printing apparatus to perform a variety of operations. The RAM 203 is used as a work area of the CPU 201 and a temporary storage area for a variety of received data items. In addition, the RAM 203 stores a variety of setting data items. The HDD 204 can store and deliver programs executed by the CPU 201, print data, and setting information necessary for the operation performed by the printing apparatus. The operation unit 15 serves as an input/output interface with the user. The operation unit 15 includes an input unit having hard keys and a touch-sensitive panel and an output unit having a display and a sound generator for outputting information.

The units that are required to perform a high-speed operation include dedicated processing unit. The image processing unit 207 performs image processing on print data manipulated by the printing apparatus. The image processing unit 207 converts the color space of the input image data (e.g., YCbCr) into a standard RGB color space (e.g., sRGB). In addition, the image processing unit 207 performs a variety of image processing, such as resolution conversion, image analysis, and image correction, on the image data as needed. Print data obtained through such image processing is stored in the RAM 203 or the HDD 204. In response to a control command received from the CPU 201, the engine control unit 208 controls driving of the print head assembly 14 of the printing unit 4 using the print data. The engine control unit 208 further controls a conveying mechanism of each of the units in the printing apparatus. The individual unit controller 209 is a sub-controller that individually controls the sheet feeding unit 1, the decurl unit 2, the skew correction unit 3, the inspection unit 5, the cutter unit 6, the information recording unit 7, the drying unit 8, the reverse unit 9, the ejection conveying unit 10, the sorter unit 11, and the ejection unit 12. In response to an instruction received from the CPU 201, the individual unit controller 209 controls the operation of each of the units. An external interface 205 is an interface (I/F) used for connecting the controller to the host apparatus 16. The external interface 205 is a local I/F or a network I/F. The above-described components of the printing apparatus are connected to one another via a system bus 210.

The host apparatus 16 serves as a supply source of image data to be printed by the printing apparatus. The host apparatus 16 may be a general-purpose computer or a dedicated computer. Alternatively, the host apparatus 16 may be a dedicated imaging device, such as an image capturing device including an image reader unit, a digital camera, or a photo storage device. The basic operation performed during a printing operation is described next. The operation in a simplex print mode differs from that in a duplex print mode. Accordingly, both the operations are described below.

In a simplex print mode, a sheet is fed from the sheet feeding unit 1 and is subjected to the processing performed by the decurl unit 2 and the skew correction unit 3. Thereafter, printing is performed on the front surface (the first surface) of the sheet in the printing unit 4. Printing of an image having a predetermined unit length in the conveying direction (a unit image) is sequentially performed on the long continuous sheet. Thus, a plurality of images are formed so as to be sequentially arranged on the continuous sheet. The printed sheet passes through the inspection unit 5 and is cut into the unit images by the cutter unit 6. The print information is printed on the back surfaces of the cut sheets in the information recording unit 7 as needed. Subsequently, the cut sheets are conveyed to the drying unit 8 one by one, where the sheets are dried. Thereafter, the sheets pass through the ejection conveying unit 10 and are sequentially ejected and stacked on the ejection unit 12 of the sorter unit 11. In contrast, the sheet remaining on the side of the printing unit 4 after the last unit image is cut out is delivered back to the sheet feeding unit 1. The sheet is wound around the roll R1 or R2. In this way, in a simplex print mode, the sheet passes through the first path and the third path. The sheet does not pass through the second path.

In contrast, in a duplex print mode, after first print sequences on the front surface (the first surface) are completed, second print sequences on the back surface (the second surface) are performed. In the first print sequences, the operations performed by the sheet feeding unit 1 to the inspection unit 5 are the same as those in the simplex print mode. However, the cutting operation is not performed by the cutter unit 6. The continuous sheet is conveyed to the drying unit 8. The drying unit 8 dries the ink on the front surface of the continuous sheet. Thereafter, the sheet is led to the path on the side of the reverse unit 9 (the second path), not the path on the side of the ejection conveying unit 10 (the third path). In the second path, the sheet is reeled in around the winding rotary member of the reverse unit 9 that rotates in the forward direction (the counterclockwise direction in FIG. 2). After the printing on planned area of the front surface is completed in the printing unit 4, the tail end of the printed area of the continuous sheet is cut by the cutter unit 6. The entirety of the portion of the continuous sheet downstream of the cut position (on the side of the printed area) in the conveying direction is rewound by the reverse unit 9 via the drying unit 8. In contrast, at the same time as the rewinding operation performed by the reverse unit 9, the portion of the continuous sheet remaining upstream of the cut position (on the side of the printing unit 4) in the conveying direction is fed back to the sheet feeding unit 1 and is reeled in around the roll R1 or R2 so that the leading edge of the portion (the cut edge) does not remain in the decurl unit 2. Through such a feeding-back operation (feedback), the sheet does not collide with the sheet that is subsequently fed for the back surface printing described below.

After the above-described front surface printing sequences are completed, the processing is switched to the back surface printing sequences. The winding rotary member of the reverse unit 9 rotates in a direction (a clockwise direction in FIG. 2) that is the reverse of the direction when the sheet was reeled in. The edge of the wound sheet (the trailing edge of the sheet when reeled is changed to the leading edge when fed) is conveyed into the decurl unit 2 along the path shown as a dashed line in FIG. 2. A curl of the sheet given by the winding rotary member is decurled in the decurl unit 2. That is, the decurl unit 2 is disposed between the sheet feeding unit 1 and the printing unit 4 in the first path and is disposed between the reverse unit 9 and the printing unit 4 in the second path. In either path, the decurl unit 2 serves as a shared unit for decurling. The turned-over sheet is advanced to the printing unit 4 via the skew correction unit 3, and printing on the back surface of the sheet is performed. The printed sheet passes through the inspection unit 5 and is cut into sheets each having a preset unit length by the cutter unit 6. Since either side of each of the cut sheets is printed, recording is not performed by the information recording unit 7. The cut sheets are conveyed to the drying unit 8 one by one. Thereafter, the cut sheets are sequentially ejected to the ejection unit 12 of the sorter unit 11 via the ejection conveying unit 10. In this way, in the duplex print mode, the sheet passes through the first path, the second path, the first path, and the third path and is processed.

Figure 4:
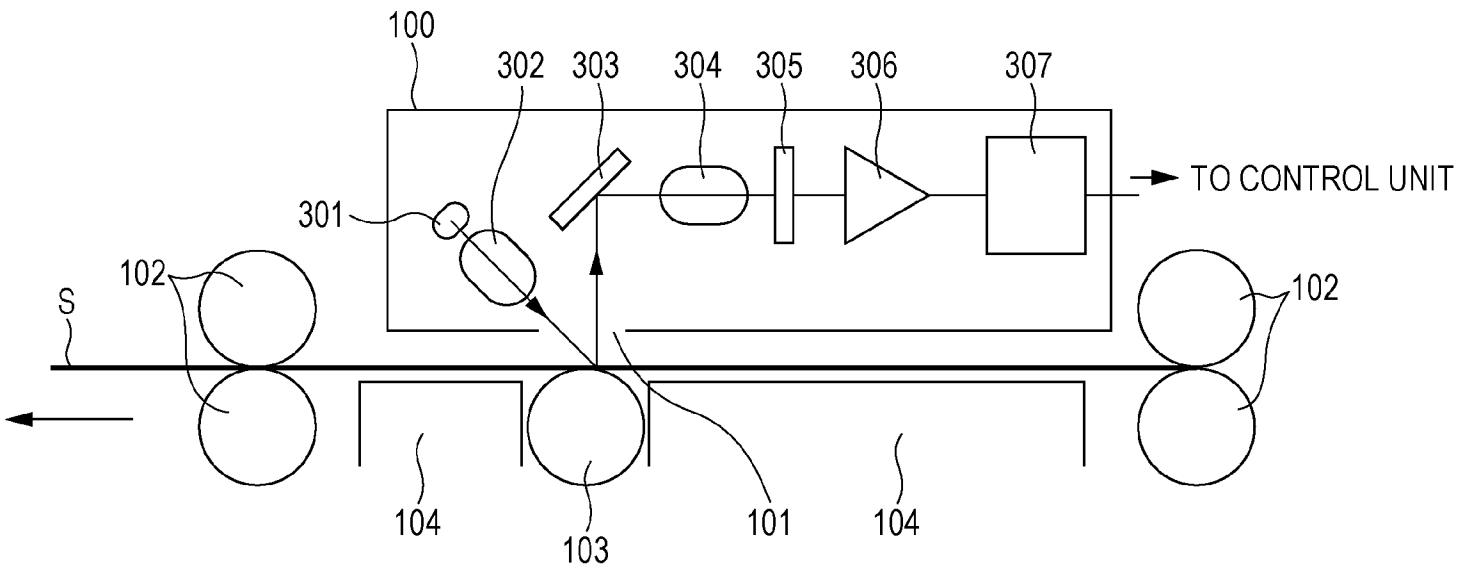
FIG. 4 is a cross-sectional view illustrating the configuration of an inspection unit.

FIG. 4 is a cross-sectional view illustrating the configuration of the inspection unit 5. A pair of conveying rollers 102 is disposed upstream of the image reading unit 100 in the sheet conveying direction (a first direction). In addition, a pair of conveying rollers 102 is disposed downstream of the image reading unit 100 in the sheet conveying direction. The back surface of the sheet S conveyed by the pairs of conveying rollers 102 is supported by a roller 103 and a platen 104, and the sheet S moves beneath the image reading unit 100.

The image reading unit 100 includes an illumination optical system and a readout optical system. The illumination optical system includes a light source 301 and a light guiding member 302. A white light emitting diode (LED) is used as the light source. The white LED emits light having a visible wavelength (400 to 700 nm) and a continuous spectrum. The light beam emitted from the light source 301 is led by the light guiding member 302 and is emitted through a slit 101, which is an elongated rectangular through-hole formed in the bottom surface of the casing of the image reading unit 100. The light beam that has passed through the slit 101 is emitted to the surface of the sheet S in a line extending along the width direction of the sheet S (the second direction, a direction perpendicular to the plane of FIG. 4). The readout optical system includes a reflecting mirror 303, a reduction imaging lens 304, and a line sensor 305. Part of the light beam reflected by the illuminated surface of the sheet S passes through the slit 101 and is led to the reflecting mirror 303. The image of the light beam reflected and bent by the reflecting mirror 303 is reduced by the reduction imaging lens 304 and is formed on the line sensor 305.

The line sensor 305 is formed from a CCD image sensor or a CMOS image sensor in which a plurality of photodetectors are formed in a line along the width direction of the sheet S. The line sensor 305 includes the photodetectors arranged therein at a predetermined pitch (e.g., a pitch corresponding to 600 dpi on the sheet S). The arranged photodetectors have a length reduced from the maximum width of the sheet S by a reduction ratio $\beta$ of the reduction imaging lens 304. In the line sensor 305, three photodetector lines corresponding to the three colors R, G, and B are arranged in parallel. Each of the photodetector lines is covered by one of R, G, and B color filters. The line sensor 305 outputs three analog signals obtained from R, G, and B components of a unit of reading on the surface of the sheet S (i.e., a pixel). The output signals output from the line sensor 305 are amplified by an amplifier 306 and are converted into a digital format by an analog-to-digital (A/D) converter 307. By reading the surface of the sheet S that is moving in the direction indicated by an arrow in FIG. 4, the image reading unit 100 can read a two-dimensional image formed on the sheet S. The signals output from the A/D converter 307 are input to the control unit 13. The control unit 13 analyzes the image in order to perform inspection regarding the print state. Examples of the inspection regarding the print state include inspection of the state of a recording element in the print head (inspection of the ink ejection state and inspection of a nozzle state, such as recording gradation) and inspection as to whether a positional shift of the entire formed image occurs).

While the present embodiment has been described with reference to the line sensor 305 that separates a light beam into R, G, and B components using color filters, the application is not limited thereto. For example, the light source 301 may include R, B, and G LEDs. The light source 301 may emit a light beam while sequentially switching among the R, B, and G LEDs. Thus, the line sensor 305 may have only one photodetector line. Alternatively, in place of the reduction imaging lens 304, a same-magnification image forming system including a lens array having a plurality of gradient index lenses (GRIN lenses) arranged in an array may be employed.

An exemplary operation performed by the inspection unit 5 during reading an image is described next. The inspection regarding the print state may be periodically performed in continuous printing steps (in a simplex print mode and a duplex print mode). Alternatively, the inspection regarding the print state may be performed before and after a series of printing steps. The operations are performed in response to instructions received from the control unit 13.

Figure 5:
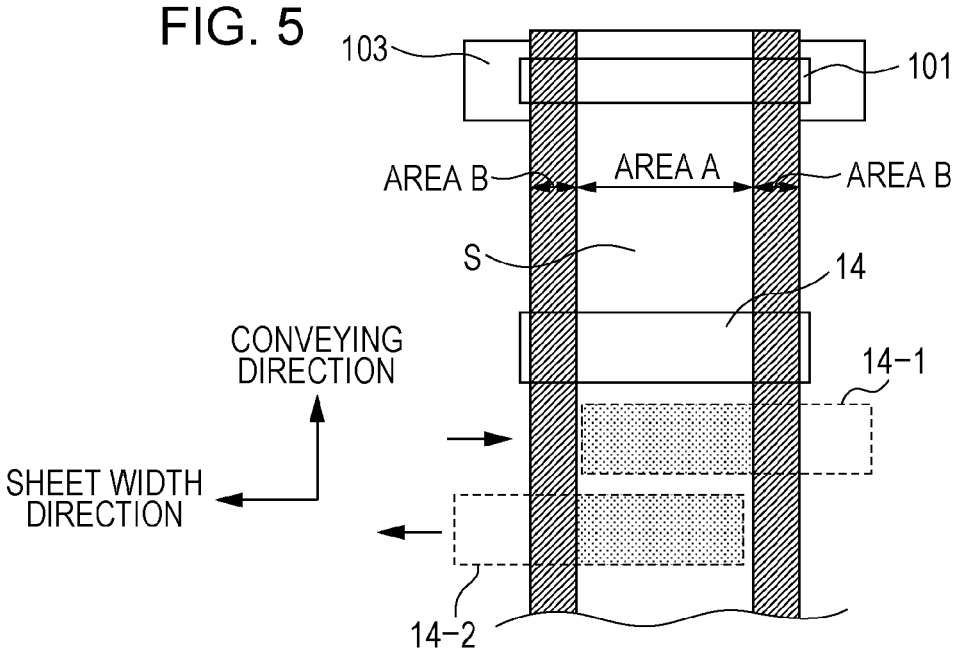
FIG. 5 illustrates an inspection procedure according to a first embodiment.

FIG. 5 illustrates a relative positional relationship among the sheet S, the roller 103, the slit 101 of the image reading unit 100, and the print head assembly 14. In this example, the sheet S has the maximum size among the sizes of usable sheets. The maximum width of a formed image of the print head assembly 14 (the maximum width of an image recorded at one time) is substantially the same as the width of the sheet. The sheet S is conveyed in the conveying direction (the first direction). The print head assembly 14 can be displaced in the sheet width direction (the second direction), that is, a direction in which the plurality of recording elements of the line print head are arranged. In practice, as described above, the print head assembly 14 includes seven print heads disposed in parallel. The print head assembly 14 can be moved by the moving mechanism disposed in the printing unit. Note that in FIG. 5, in order to describe three states of the moving print head assembly 14, three print head assemblies 14 are shown in the up-down direction (the conveying direction). However, in practice, the print head assembly 14 does not move in the up-down direction, but moves only in the left-right direction (the sheet width direction).

Figure 1:
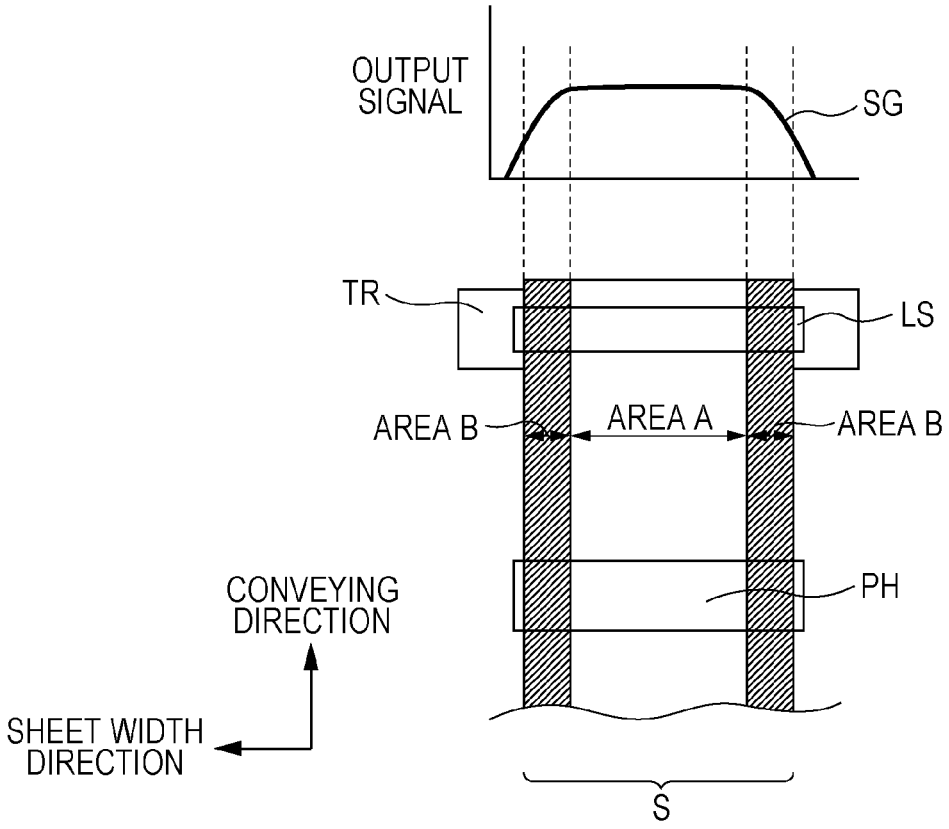
FIG. 1 illustrates a problem to be solved by the present invention.

During a normal print operation without inspection (in a print mode), the print head assembly 14 is located in the middle indicated by a solid line. Under the control of the control unit 13, the print mode is switched to an inspection mode. As illustrated in FIG. 1, when the inspection unit 5 performs inspection, the sheet S has the areas B having a predetermined length at either end of the sheet S in the width direction and the area A including the middle area of the sheet S and excluding the areas B. In the image reading unit 100, the accuracy with which an image formed in each of the areas B is read is lower than the accuracy with which an image formed in the area A is read.

According to the present embodiment, to prevent degradation of the accuracy with which the area B is read, the following operation sequence is employed. The basic idea is that in an inspection mode, the position of the print head assembly 14 in the width direction of the sheet is changed, an image is formed on the sheet using the print head assembly 14 a plurality of times, and the image reading unit 100 reads the plurality of formed images. In an inspection mode, there is a case in which the relative positional relationship between the print head assembly 14 and the sheet feeding position in the width direction of the sheet S differs from that in a print mode. In an inspection mode, the relative positional relationship is changed and an image is formed on the sheet a plurality of times so that at least the entirety of the print head area used in a print mode is included in the area A that includes the middle area of the sheet excluding the areas B in the width direction.

First, the print head assembly 14 located at a normal position (the position in a print mode) is moved in the width direction of the sheet (the right direction in FIG. 5) so that the left end portion of the head is moved away from the area B and is located in the area A (refer to a print head assembly 14-1 shown by a dashed line). At that time, by using the recording elements of the print head assembly 14-1 included in the area A, a first measurement image is formed on the sheet S while the sheet S is being moved (a step of forming a measurement image 1). Note that no measurement image is formed in the area B. Thereafter, while the sheet S is being conveyed, the formed first measurement image is read using the image reading unit 100. Thus, image data including R, G, and B components can be acquired. The control unit 13 analyzes the image data and inspects the state of the recording elements located in a partial area of the print head assembly 14-1 (the left grey area in FIG. 5).

Subsequently, the print head assembly 14 located at a normal position (the position in a print mode) is moved in the width direction of the sheet (the right direction in FIG. 5) so that the left end portion of the head is moved away from the area B and is located in the area A (refer to a print head assembly 14-2 shown by a dashed line). At that time, by using the recording elements of the print head assembly 14-2 included in the area A, a second measurement image is formed on the sheet S while the sheet S is being moved (a step of forming a measurement image 2). Through the two image forming operations, at least the entirety of the print head area used in a print mode is included in the area A. Thereafter, while the sheet S is being conveyed, the formed second measurement image is read using the image reading unit 100. Thus, image data including R, G, and B components can be acquired. By analyzing the image data, the recording elements in the other partial area of the print head assembly 14-2 (the right grey area in FIG. 5) can be inspected. In this way, by changing the position of the print head and forming and reading an image twice, all of the recording elements included in the print head assembly 14 can be inspected without using the area B. Since only the area A providing a high accuracy of reading is used, the entirety of a usable portion of the print head including the elements disposed in the end portions of the print head can be inspected with high accuracy.

If the size of a measurement image in the conveying direction is small, a second measurement image may be formed on the sheet S immediately after a first measurement image is formed on the sheet S. Thereafter, the image reading unit 100 may continuously read the first measurement image and the second measurement image.

In FIG. 5, by moving the print head assembly 14 and inspecting the first state and the second state, the entirety of the print area of the print head assembly 14 can be included in the area A. However, the number of image formations and image reading is not limited to two. For example, image formation and image reading may be repeated three times or even more.

Figure 6:
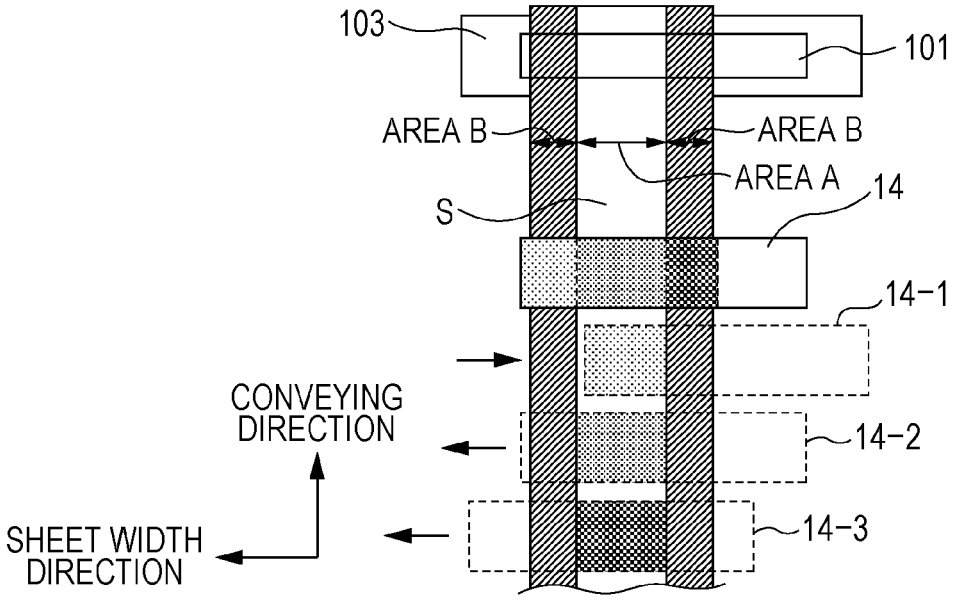
FIG. 6 illustrates another example of the first embodiment.

FIG. 6 illustrates the case in which the width of the used sheet S is smaller than that in FIG. 5, that is, the case in which the width of the sheet S is smaller than the maximum image forming width of the print head. Only a left partial area of the print head assembly 14 is used for printing an image on the sheet S. The print head assembly 14 in the partial area is inspected. In this case, the print head assembly 14 is moved so that three states occur. When a mode is switched from a print mode to an inspection mode, the print head assembly 14 located at the normal position (the position in a print mode) is sequentially moved to the positions of a print head assembly 14-1 (measurement image formation 1), a print head assembly 14-2 (measurement image formation 2), and a print head assembly 14-3 (measurement image formation 3). In the measurement image formation 2, the print head assembly 14-2 is located at the same position as in the print mode. At each position, a measurement image is formed on the sheet S. Through the three image formations, the entirety of the print area of the print head assembly 14 at least used for the print mode is included in the area A. In this way, by reading a measurement image formed in the area A using the image reading unit 100 each time the position is changed and the measurement image is formed, the recording elements of the print head assembly 14 in at least the area usable for recording information on the sheet S can be inspected. If it is desirable that even the recording elements of the print head assembly 14 in the unusable area be inspected, the print head assembly 14 can be moved to the left beyond the position for the measurement image formation 3 so that the right end of the print head assembly 14 is included in the area A. Thereafter, image formation and image reading can be performed. In this way, the area of the print head assembly 14 that is larger than the width of the sheet S can be inspected using the sheet S having a width smaller than the maximum image forming width of the print head assembly 14.

According to the present embodiment, a relative positional relationship between the print head assembly 14 and the feed position of the sheet S in a direction perpendicular to the sheet conveying direction is changed a plurality of times, and an image is formed on the sheet a plurality of times. Thereafter, the plurality of formed images are read by the image reading unit 100. In an inspection mode, there is a case in which the relative positional relationship between the print head assembly 14 and the sheet feeding position in the width direction of the sheet differs from that in a print mode. Since inspection is carried out without using the area B, the inspection of a print head area used in at least a print mode can be carried out with an accuracy higher than ever before.

If the size of a sheet used is fixed at all times, line sensors for the areas A and B having different sensitivities may be disposed. Alternatively, the illumination distribution of the illumination light for the area B can be made greater than that for the area A. However, in printing apparatuses capable of using sheets having a variety of sizes, the positions of the area A and the area B vary in accordance with the sheet size. Accordingly, the method of the present embodiment is advantageous.

Second Embodiment

A second embodiment of the present invention is described next. The configuration of a printing apparatus is the same as the configuration illustrated in FIG. 2. In the first embodiment described above, the position of the print head assembly 14 in the width direction of the sheet is changed, and an image is formed on the sheet a plurality of times. Thereafter, the plurality of formed images are read using the image reading unit 100. In contrast, according to the second embodiment, the basic idea is that the sheet feeding position of the sheet S relative to the print head assembly 14 in the width direction of the sheet S is changed and an image is formed on the sheet S a plurality of times. Thereafter, the plurality of formed images are read using the image reading unit 100. The print head assembly 14 does not move and remains fixed. In addition, in an inspection mode, there is a case in which the relative positional relationship between the print head assembly 14 and the sheet feeding position in the width direction of the sheet S differs from that in a print mode.

Figure 7A:
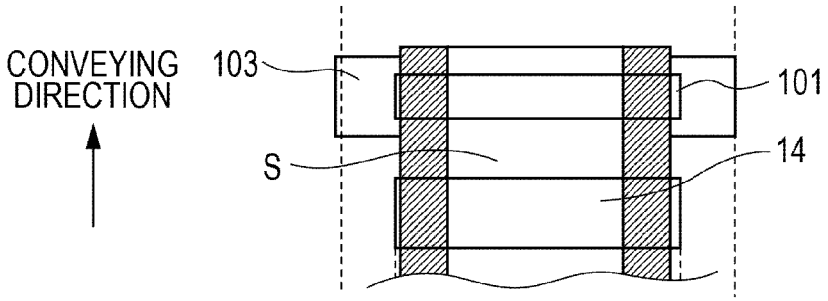
FIGS. 7A to 7C illustrate an inspection procedure according to a second embodiment.
Figure 7B:
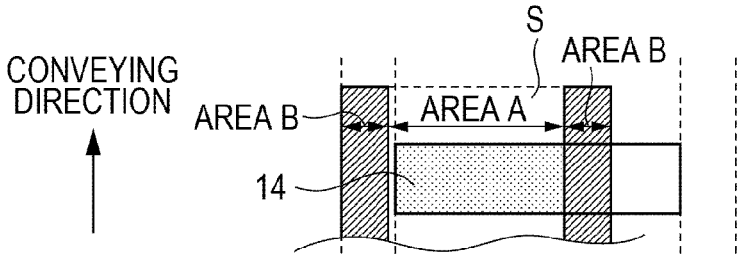

FIG. 7A illustrates the positional relationship during a normal image printing operation without inspection (normal image formation: a print mode). The sheet S is fed so that the center of the print head assembly 14 in the sheet width direction is aligned with the center of the sheet S. In contrast, as shown in FIG. 7B (measurement image formation 1: an inspection mode), in order to inspect the print head assembly 14, the sheet feeding position for the sheet S in the sheet width direction is shifted to the left. At that time, the left end portion of the print head assembly 14 is located in the area A, and the right end portion of the print head assembly 14 is away from the area A. The sheet S is then moved, and a first measurement image is formed in the area A of the sheet S using the recording elements of the print head assembly 14 located in the area A. No measurement image is formed in the area B. Thereafter, the sheet S is conveyed, and the formed first measurement image is read using the image reading unit 100. Thus, image data including R, G, and B components is acquired. The control unit 13 analyzes the image data and inspects the state of the recording elements located in the partial area of the print head assembly 14 (the left gray area in FIG. 7B).

Figure 7C:
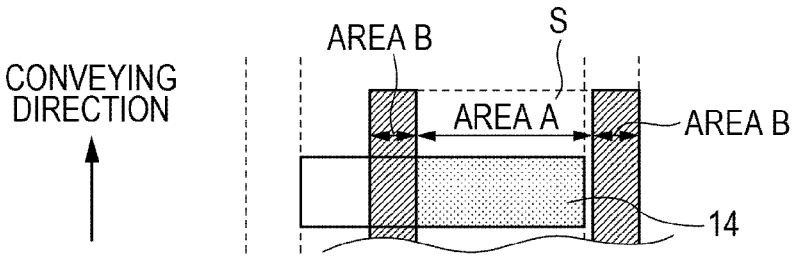

Subsequently, as shown in FIG. 7C (measurement image formation 2: an inspection mode), the sheet feeding position is changed so that the right end portion of the print head assembly 14 is located in the area A. At that time, the sheet S is moved, and a second measurement image is formed on the sheet S using the recording elements of the print head assembly 14 located in the area A. Thereafter, the sheet S is conveyed, and the formed second measurement image is read using the image reading unit 100. Thus, image data including R, G, and B components is acquired. By analyzing the image data, the state of the recording elements in the other partial area of the print head assembly 14 (the right gray area in FIG. 7B) can be inspected. As described above, the relative positional relationship between the print head assembly 14 and the sheet feeding position for the sheet S is changed, and image formation and image reading are performed twice. In this way, all of the recording elements included in the print head assembly 14 can be inspected without using the area B. That is, through the two image formations, the entirety of the area of the print head assembly 14 used in at least a print mode is included in the area A. Since inspection is carried out without using the area B, inspection regarding a print operation performed using the print head area in at least a print mode can be carried out more accurately than ever before.

Third Embodiment

A third embodiment of the present invention is described next. The configuration of a printing apparatus is the same as that shown in FIG. 2. The basic idea is that the width of a sheet used during measurement image formation (in an inspection mode) is made larger than that used during normal print image formation (in a print mode). In addition, the width of a sheet used during measurement image formation (in an inspection mode) is made larger than the width of the print head assembly 14. If a sheet having such a size is used, the area of the sheet is present outside the formed measurement image (no image in that area) when the image reading unit 100 reads the measurement image. Accordingly, a decrease in the level of the detection signal in the area B can be reduced.

Figure 8A:
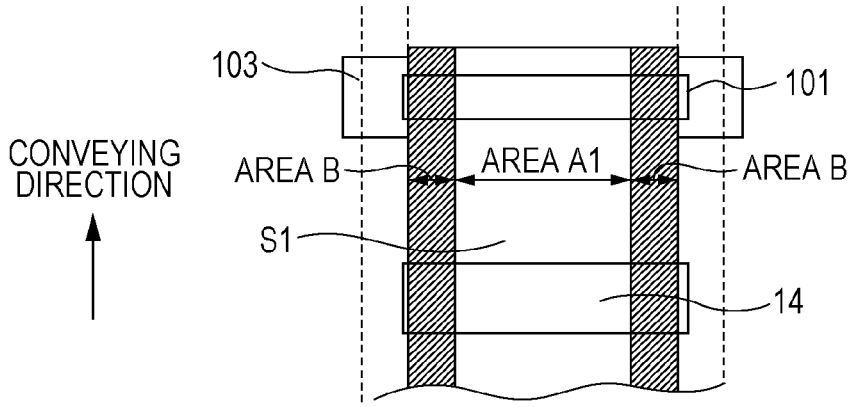
FIGS. 8A and 8B illustrate an inspection procedure according to a third embodiment.
Figure 8B:
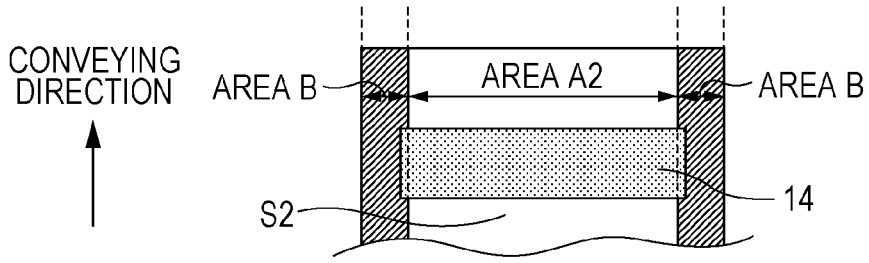

During normal image formation (refer to FIG. 8A), a sheet S1 is used. However, during measurement image formation (refer to FIG. 8B), a sheet S2 is used. The width of the sheet S2 is larger than that of the sheet S1. It is desirable that the sheet width of the sheet S2 be larger than or equal to the value: the sheet width of the sheet S1+(the width of the area B×2).

In addition, sheets having a variety of sizes can be used as the sheet S1. However, the designed maximum sheet width is the same as the maximum image formation width of the print head assembly 14. Accordingly, it is desirable that the maximum sheet width of the sheet S2 be larger than the maximum image formation width of the print head assembly 14. It is more desirable that the maximum sheet width of the sheet S2 be larger than the value: the maximum image formation width of the print head assembly 14+a predetermined value (the width of the area B×2). By using a sheet having a size that meets the above-described condition and performing measurement image formation and image reading, inspection associated with printing can be carried out more accurately than ever before.

Fourth Embodiment

A fourth embodiment of the present invention is described next. The configuration of a printing apparatus is the same as that shown in FIG. 2. The basic idea is that selectable first measurement mode and second measurement mode are provided. In the first measurement mode, like the first embodiment or the second embodiment, the print head assembly 14 or the sheet feeding position for the sheet S is moved and a measurement image is formed. In the second mode, the print head assembly 14 and the sheet feeding position for the sheet S are not moved. One of the two modes is selected in accordance with the type of inspection associated with printing.

Figure 9:
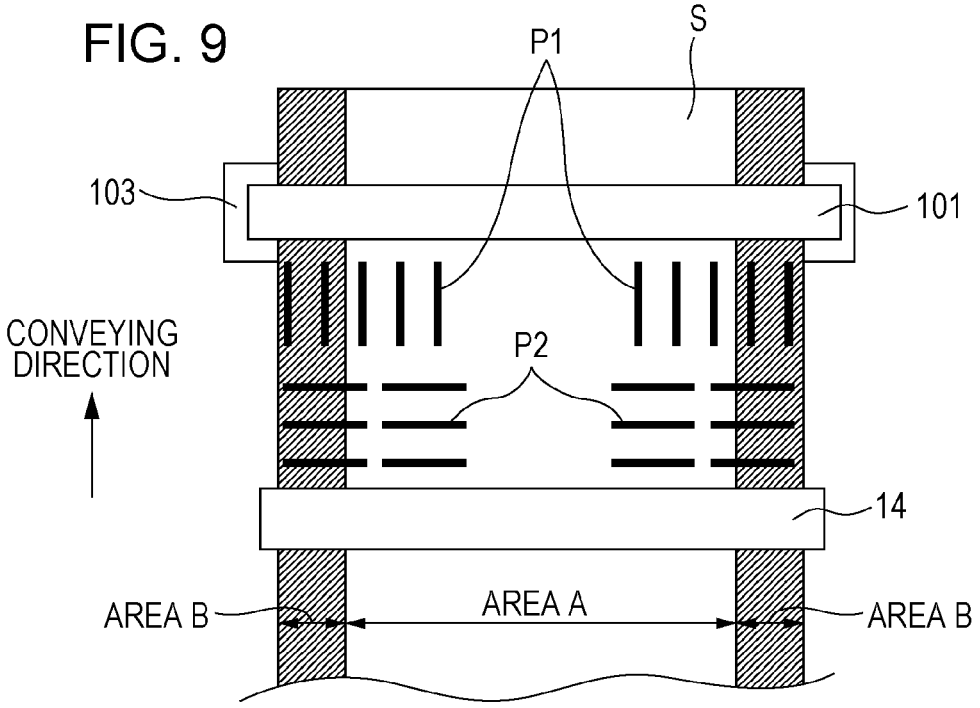
FIG. 9 illustrates an example in which a high-contrast test pattern is formed as a measurement image.
Figure 10:
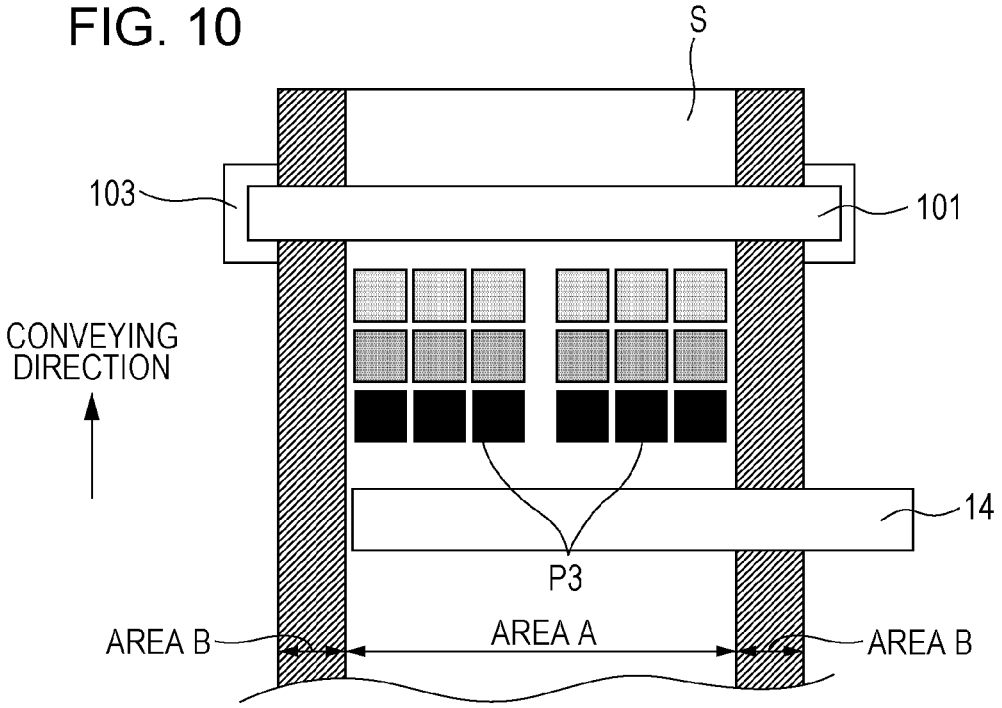
FIG. 10 illustrates an example in which a gradation pattern is formed as a measurement image.

FIGS. 9 and 10 illustrate examples in which different types of measurement image are formed. In FIG. 9, a high-contrast pattern mainly including a vertical line pattern P1 or a horizontal line pattern P2 is formed as a measurement image. The pattern shown in FIG. 9 is suitable for inspecting whether a particular recording element included in the print head assembly 14 has an ink ejection defect. If a particular recording element malfunctions, recording performed by the recording element is faint, or the recording position is shifted. Therefore, by analyzing the pattern formed on the sheet S, a recording element that malfunctions can be detected. In addition, the pattern is suitable for detecting a shift of the entire printed image from the original position at which the image is to be formed. The shift of the image position occurs when an error in transfer of the sheet S occurs due to slippage of a conveying roller, an eccentric conveying roller, or a deformed conveying roller.

In the pattern shown in FIG. 9, the contrast between a portion in which the pattern is present and a portion in which the pattern is not present is large. Accordingly, the presence of the pattern can be easily detected even for an image read using the area B in which the accuracy of reading is low. Unlike the above-described embodiments, the operation for not using the area B is not necessary. Therefore, when a high-contrast pattern as shown in FIG. 9 is formed as a measurement image and image reading is performed, the second measurement mode is selected. Thus, inspection is carried out without moving the print head assembly 14 and changing the sheet feeding position for the sheet S.

In contrast, FIG. 10 illustrates an example in which as a measurement pattern, a gradation pattern having a plurality of patch patterns P3 periodically arranged therein is formed by gradually changing the color density, the brightness of color, or the chromaticity. The pattern shown in FIG. 10 is suitable for inspecting a slight change in the recording characteristic of each of the elements included in the print head assembly 14 (the actually recorded gradation with respect to a drive signal of the element). If the recording characteristics of the elements included in the print head assembly 14 are not uniform, the formed image may include a streak or nonuniform density. Accordingly, it is desirable that the drive signal be corrected so that the color density, the color value, and the chromaticity are uniform. When such a gradation pattern is read using the image reading unit 100, the intensity of the reflected light from the pattern needs to be detected with high resolution. Therefore, it is not desirable to use the area B for which the intensity of the reflected light significantly varies in accordance with the distance from the end of the sheet S. Thus, the measurement image is formed and read by using only the area A. Consequently, when the gradation pattern as shown in FIG. 10 is formed as a measurement image and the formed image is read, the mode is switched to the first measurement mode. Thus, like the first embodiment or the second embodiment, the position of the print head assembly 14 or the sheet feeding position for the sheet S is changed and, subsequently, a measurement image is formed.

According to the fourth embodiment, the print head assembly 14 or the sheet feeding position for the sheet S need not be moved in the second measurement mode. Thus, inspection can be carried out at higher speed than in the first measurement mode. As a result, the total print throughput can be increased.

While the foregoing embodiments have been described with reference to a printing apparatus that performs a duplex print operation on a continuous sheet, the present invention is not limited to such a printing apparatus. For example, the present invention is applicable to a printing apparatus that performs a simplex print operation or a duplex print operation on pre-cut sheets each having a predetermined size.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A method comprising:

providing a print head of a line-type having an array of recording elements arranged in a direction including a vector of a second direction perpendicular to a first direction in which sheets are conveyed;

providing a sensor having an array of photodetectors arranged along a sensor length including a vector of the second direction; and performing a print mode in which actual images are formed with the print head using a first sheet to receive the actual images, and reading is not performed with the sensor; and performing an inspection mode in which inspection patterns are formed with the print head using a second sheet having a size in the second direction larger than both that of the first sheet and the sensor length to receive the inspection patterns, and the formed inspection patterns are read with the sensor.

2. The method according to claim 1, wherein the size of the second sheet used in the inspection mode in the second direction is larger than a maximum image forming width of the print head.

3. The method according to claim 1, wherein the print head ejects ink from a plurality of nozzles as the recording elements using an inkjet method, and inspection of color states of the formed inspection patterns is performed in accordance with the pattern reading.

4. The method according to claim 1, wherein in the print mode, a plurality of actual images are sequentially printed on a first surface of the first sheet with the print head, the first sheet having the printed first surface is reversed and is fed to the printing unit again, a plurality of actual images are sequentially printed on a second surface which is the back of the first surface, and the first sheet having the printed second surface is cut into a plurality of cut sheets.

* * * * *